US006281419B1

(12) United States Patent
Arimori

(10) Patent No.: US 6,281,419 B1
(45) Date of Patent: Aug. 28, 2001

(54) METHOD OF MOUNTING PLATE IN GRAND PIANO

(75) Inventor: Manabu Arimori, Shizuoka-ken (JP)

(73) Assignee: Kabushiki Kaisha Kawai Gakki Seisakusho, Hamamatsu (JP)

( * ) Notice: Subject to any disclaimer, the term of this patent is extended or adjusted under 35 U.S.C. 154(b) by 0 days.

(21) Appl. No.: 09/689,736

(22) Filed: Oct. 13, 2000

(30) Foreign Application Priority Data

Oct. 18, 1999 (JP) ..... 11-294762

(51) Int. Cl.[7] ..... G10C 3/12

(52) U.S. Cl. ..... 84/438; 84/184; 84/185; 84/187; 84/192; 29/896.22

(58) Field of Search ..... 84/438, 184, 185, 84/187, 188, 192; 29/896.22

(56) References Cited

U.S. PATENT DOCUMENTS 612,222 * 10/1898 Ziegler ..... 84/184
1,575,668 * 3/1926 Weiser ..... 84/187
2,107,659 * 2/1938 Bilhuber ..... 84/192
4,873,906 * 10/1989 Herwig ..... 84/184
6,145,197 * 11/2000 Kitashima et al. ..... 29/896.22

OTHER PUBLICATIONS

Piano Servicing, Tuning, and Rebuilding Arthur A. Reblitz Library of Congress Cataloging in Publication data, The Vestal Press Ltd. Vestal, N.Y., 1993.*

* cited by examiner

*Primary Examiner*—Shih-Yung Hsieh
(74) *Attorney, Agent, or Firm*—Crowell & Moring, L.L.P.

(57) ABSTRACT

A method of mounting a plate in a grand piano is provided for ensuring an appropriate bridge pressure in accordance with an actual amount of swelling of a soundboard and its distribution in a simple manner without requiring bridge pressure setting and re-adjustment. The method comprises the steps of measuring the heights of a bridge from a reference plane at a plurality of predetermined positions of the bridge on the back assembly; attaching a plurality of plate bases at a plurality of positions along the outer periphery of the top surface of the back assembly at heights corresponding to the measured heights of the bridge; and carrying the plate on the plurality of plate bases, and fixing the plate carried on the plate bases to the back assembly.

7 Claims, 5 Drawing Sheets

METHOD OF MOUNTING PLATE IN GRAND PIANO

BACKGROUND OF THE INVENTION

1. Field of the Invention

The present invention relates to a method of mounting a plate in a grand piano, and more particularly, to a method of mounting a plate on a base assembly of a grand piano in which an outer rim, a sound board, and so on have already been assembled.

2. Description of the Related Art

A plate of a grand piano comprises a back mechanism together with a back assembly comprised of an outer rim, a soundboard and so on, and serves to support tensions applied to strings attached therein. FIGS. 1 and 2 show an example of a conventional method of mounting a plate on a back assembly. The illustrated back assembly comprises an outer rim 2, a backpost (not shown) and a back beam 3, which have been integrally assembled, a soundboard 4 adhered to overlay the top surfaces of these components, and so on. The soundboard 4 has been previously mounted with a long bridge 5 and a short bridge 6 on its top surface, and a plurality of sound ribs (not shown) on its bottom surface. Also, the soundboard 4 is forcedly dried before the ribs are mounted, and left in a normal state after the ribs are mounted to cause the top surface side to swell due to restrictions imposed by the sound ribs, so that a crown has been previously formed. The long bridge 5 and the short bridge 6, in turn, have respective predetermined lengths, and have been individually worked. Specifically, each bridge is shaved on the top surface at locations at which strings are fixed (hereinafter called the "bridge shaving") and bridge pins are struck into the bridge hooking strings (hereinafter called the "bridge pin striking"). The bridges 5, 6 are adhered on the top surface of the soundboard 4 after such working has been completed individually on the respective bridges.

For mounting a plate 7 on the back assembly 1 constructed as described above, a set of holes consisting of dowel holes 8*a* on both sides, and a lower hole 8*b* in the middle of the dowel holes 8*a* are drilled, for example, by means of a three-fluted drill fixed to an NC machine, from the top surface of the soundboard 4 deep into the middle of the inner rim 2 at a plurality of predetermined positions along the outer periphery of the top surface of the back assembly 1. In this event, as shown in FIG. 2, the depth of the dowel holes 8*a* is set with reference to the bottom surface of the inner rim 2, such that the height of the dowel holes 8*a* from the bottom surface of the inner rim 2 to the bottom of the dowel holes 8*a* is equal to a predetermined constant height H. Next, after a dowel 9 having a predetermined length L is driven deep into the bottom of each dowel hole 8*a*, the plate 7 is carried on the dowels 9, and mounting screws 11 are inserted into bolt holes 10 and the lower hole 8*b* previously formed through the plate 7, and fastened to mount the plate 7 on the back assembly 1. In this way, an installation height HF of the plate 7 (from the bottom surface of the inner rim 2 to the bottom surface of the plate 7) is set to a constant value equal to the sum of the height H of the bottom of the dowel holes 8*a* and the length L of the dowels 9 (HF=H+L).

As described above, the long bridge 5 and the short bridge 6 are set at a predetermined thickness, and the installation height HF of the plate 7 is set at a constant value to allow a bridge pressure (a relative height between strings stretched on the plate 7 and the top surface of the long bridge 5 and the short bridge 6) to be controlled to some extent. As a result, it is possible to eliminate a time-consuming bridge pressure adjustment (which involves planing the top surface of the long bridge 5 or the like for achieving an appropriate bridge pressure after the soundboard 4 has been mounted on the inner rim 2), which has been traditionally performed.

While the foregoing conventional plate mounting method can relatively accurately set the installation height HF of the plate 7 with reference to the bottom surface of the inner rim 2, the method encounters significant difficulties in correctly controlling the shape of the crown since it is formed by the swelling of the soundboard 2 itself, as stated above, and the heights of the long bridge 5 and the short bridge 6 from the bottom surface of the inner rim 2 may vary in accordance with the amount of the swelling. Thus, the heights of the long bridge 5 and the short bridge 6 inevitably vary from one piano to another, and as a result, the bridge pressure, determined by a relative height relationship between the long bridge 5 and the short bridge 6 and the plate 7, also varies from one piano to another, causing a problem that an appropriate bridge pressure cannot be ensured.

OBJECT AND SUMMARY OF THE INVENTION

The present invention has been made in view of the problem mentioned above, and it is an object of the present invention to provide a method of mounting a plate in a grand piano which is capable of ensuring an appropriate bridge pressure in accordance with an actual amount of swelling of the soundboard and its distribution by means of a simple expedient without requiring the setting and re-adjustment of the bridge pressure.

To achieve the above object, the present invention provides a method of mounting a plate on a back assembly having a soundboard assembled therein and a bridge adhered on a top surface of the soundboard in a grand piano. The method comprising the steps of measuring the heights of the bridge from a reference plane at a plurality of predetermined positions of the bridge on the back assembly; attaching a plurality of plate bases at a plurality of positions along the outer periphery of the top surface of the back assembly at heights corresponding to the measured heights of the bridge; and carrying the plate on the plurality of plate bases, and fixing the plate carried on the plate bases to the back assembly.

According to this mounting method, the plate is mounted on the back assembly having the soundboard assembled therein with the bridge adhered on the top surface thereof, in the following manner. First, the heights of the bridge from the reference plane are measured at a plurality of positions. Then, the plurality of plate bases are attached at a plurality of positions along the outer periphery of the top surface of the back assembly at heights corresponding to the measured heights of the bridge. Then, the plate is carried on these plate bases, and fixed on the back assembly as it remains carried on the plate bases.

As described above, the mounting method of the present invention measures the actual heights of the bridge with the soundboard assembled in the back assembly, and the plurality of plate bases are attached to the back assembly at predetermined heights in accordance with the measured heights of the bridge. Therefore, a relative height relationship between the bridge and the plate fixed as carried on the plate bases, i.e. the bridge pressure can be optimally controlled in accordance with the actual amount of swelling of the soundboard previously formed thereon. As a result, an optimal bridge pressure can be ensured with the plate mounted in the manner described above, thereby eliminating subsequent bridge pressure setting and re-adjustment.

Preferably, in the foregoing method, the predetermined heights of the plurality of plate bases are individually determined in accordance with the height of the bridge measured at the position closest to each of the plate bases.

In this preferred form, since the plurality of plate bases are individually determined in accordance with the height of the bridge measured at the position closest to each plate base, an optimal bridge pressure can be accurately ensured in accordance with the actual amount of swelling of the soundboard previously formed thereon and its distribution.

Also preferably, in the foregoing method, the plurality of plate bases comprise a plurality of buried members mutually having the same predetermined height, wherein the step of attaching the plate bases comprising the steps of forming a plurality of burying holes at predetermined depths in accordance with the measured heights of the bridge at the plurality of positions on the top surface of the back assembly; and burying the plurality of buried members into the plurality of burying holes to the bottom thereof.

In this preferred form, the plurality of burying members are formed at predetermined depths in accordance with the measured heights of the bridge at the plurality of positions on the top surface of the base assembly, and the buried members having the same predetermined height are buried into the burying holes to the bottom as the plate bases, thereby making it possible to appropriately control the relative height relationship between the bridge and the plate carried on the buried members, i.e., the bridge pressure, and accordingly ensure an appropriate bridge pressure. Also, since this mounting method only adds to the conventional mounting method the step of measuring the heights of the bridge, and the step of forming the buried holes at the predetermined depths determined in accordance with the result of the measurement, the method can be relatively easily implemented.

Further preferably, in the foregoing method, the plurality of plate bases comprise a plurality of buried members, wherein the step of attaching the plate bases comprising the steps of forming a plurality of burying holes at the plurality of positions on the top surface of the back assembly; burying the plurality of buried members into the plurality of burying holes, respectively; and planing top surfaces of the buried members buried into the burying holes to respective predetermined heights in accordance with the measured heights of the bridge.

In this preferred form of the mounting method, the top surfaces of the buried members buried into the burying holes are planed to a predetermined height in accordance with the measured heights of the bridge, thereby ensuring an appropriate bridge pressure in a manner similar to the foregoing form.

Further preferably, in the foregoing method, the plurality of burying holes comprise a plurality of dowel holes, and the plurality of buried members comprise a plurality of dowels respectively driven into the plurality of dowel holes.

In this preferred form of the mounting method, since the buried members comprise bowels driven into the dowel holes the dowels, so far employed in the conventional mounting method, can be applied as they are, so that the method can be further readily Implemented.

Further preferably, in the foregoing method, the plurality of plate bases comprise a plurality of adjusting screws, wherein the step of attaching the plate bases comprises screwing the plurality of adjusting screws respectively into the plurality of positions on the top surface of the back assembly such that the height of the adjusting screws is equal to a predetermined height in accordance with the measured heights of the bridge.

In this preferred from of the mounting method, the amounts of screwing strokes of the plurality of adjusting screws screwed into the plurality of positions on the top surface of the back assembly are adjusted such that the height of the adjusting screws is equal to the predetermined height in accordance with the measured heights of the bridge, thereby ensuring an appropriate bridge pressure in a manner similar to the foregoing forms.

DETAILED DESCRIPTION OF THE PREFERRED EMBODIMENTS

Figure 1:
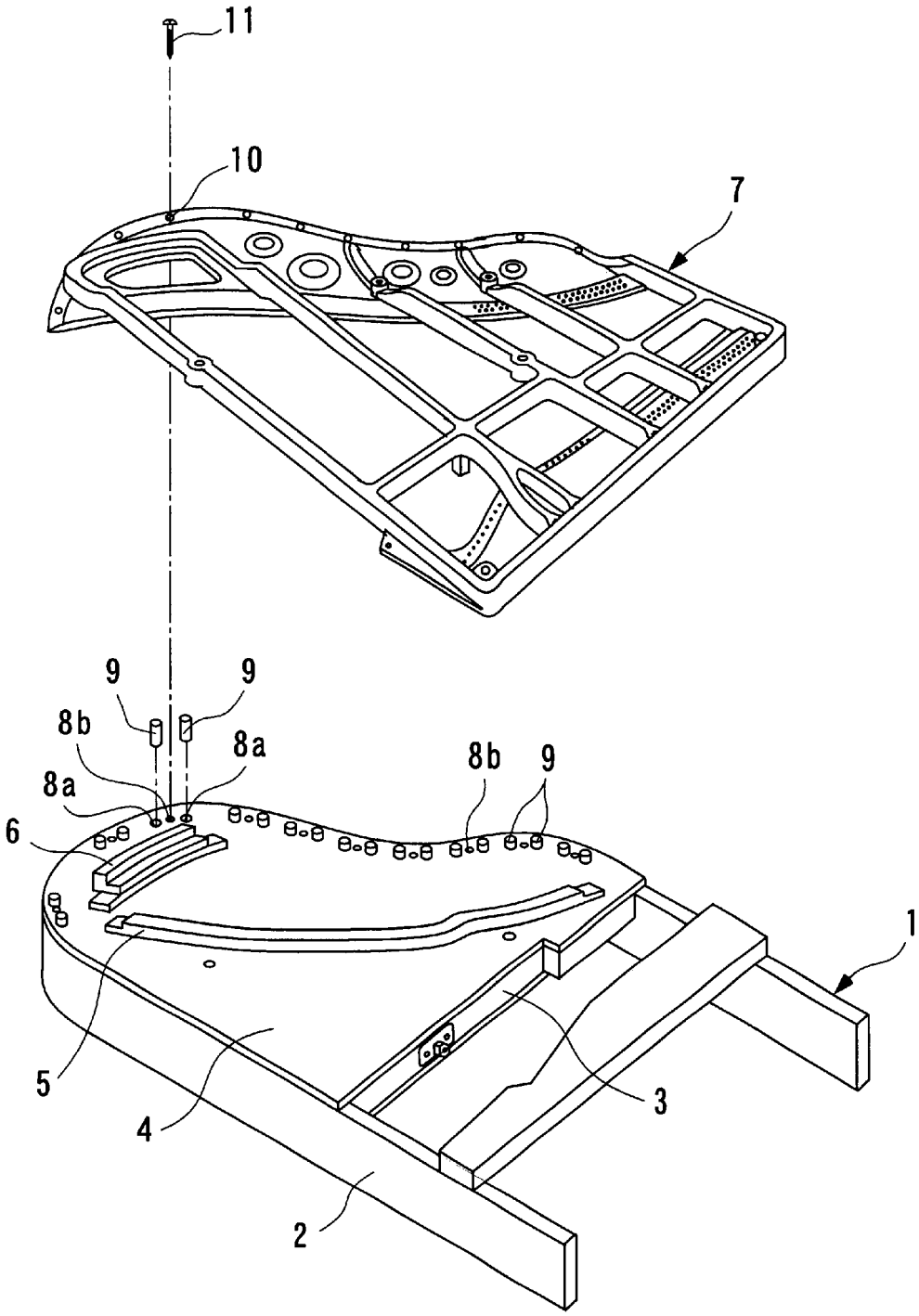
FIG. 1 PRIOR ART
FIG. 1 is a perspective view showing how a plate is mounted on a back assembly in a conventional mounting method.
Figure 2:
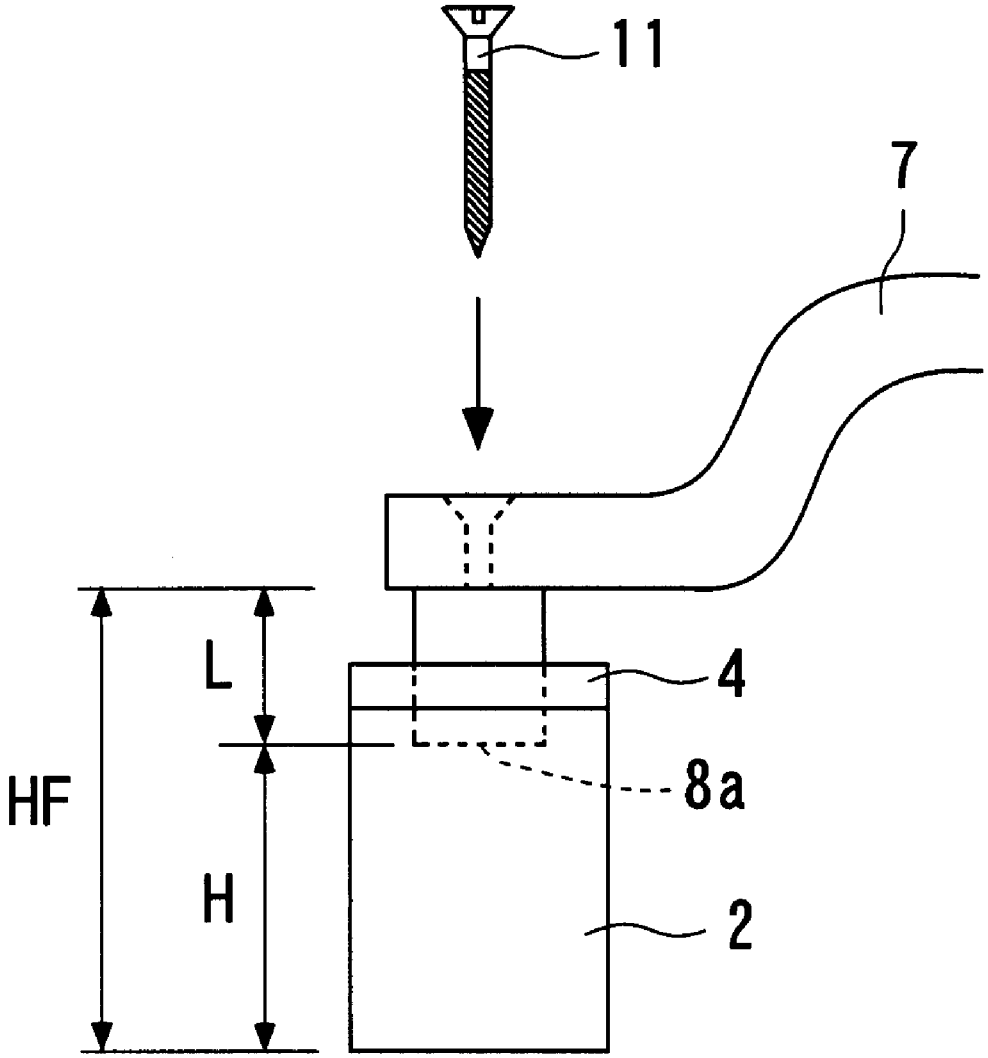
FIG. 2 PRIOR ART
FIG. 2 is a diagram showing how the plate is mounted in the conventional mounting method.

Several preferred embodiments of the present invention will hereinafter be described in detail with reference to the accompanying drawings. It should be first noted that components identical to those of the previously described conventional grand piano are designated the same reference numerals.

Figure 3A:
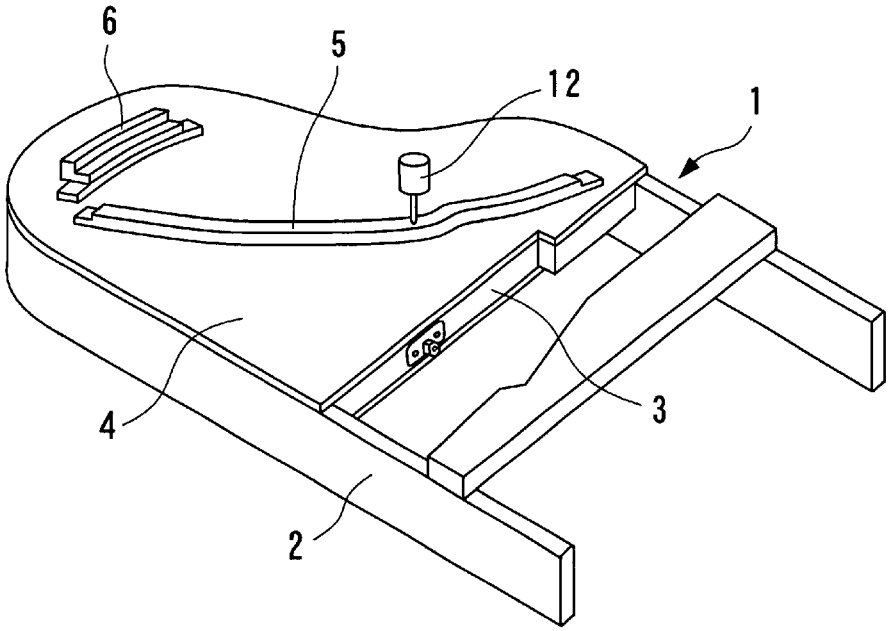
FIG. 3A shows how the height of a bridge is measured in a method of mounting a plate in a grand piano according to a first embodiment of the present invention.
Figure 3B:
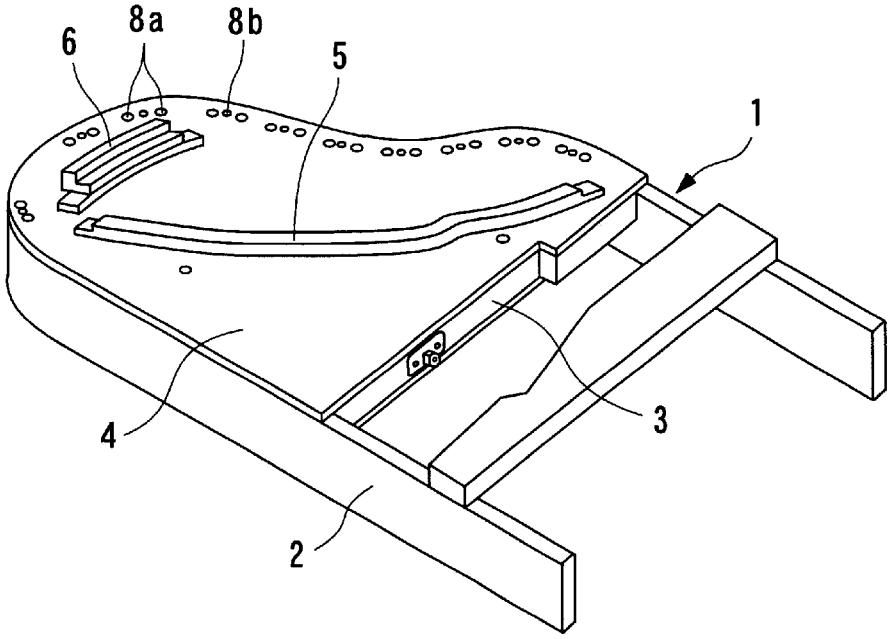
FIG. 3B shows dowel holes formed in a back assembly.
Figure 4:
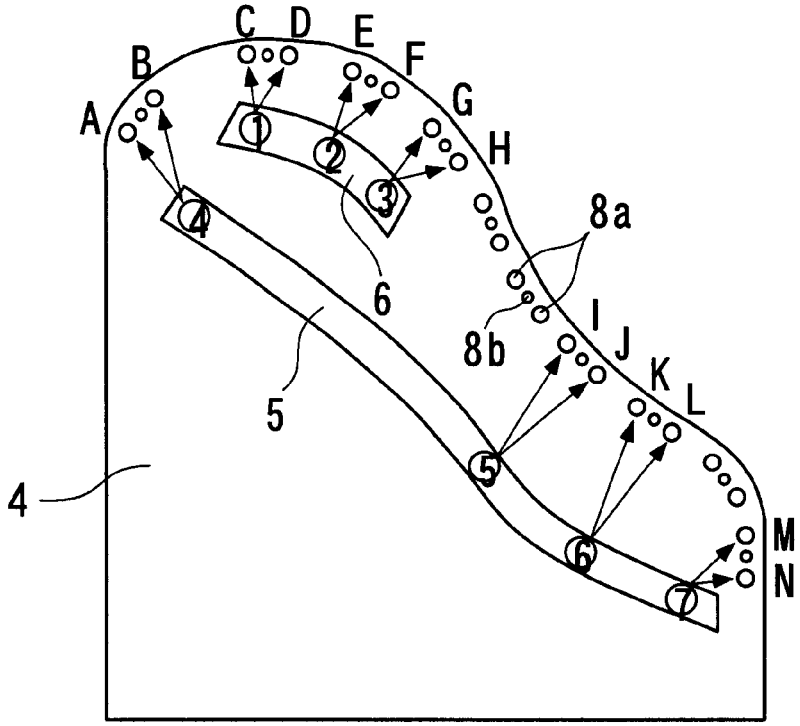
FIG. 4 is a diagram showing a correspondence relationship between bridge height measuring positions and dowel holes.

FIGS. 3 through 5 show a method of mounting a plate of a grand piano according to a first embodiment of the present invention. A back assembly 1, on which a plate 7 is mounted, is similar in construction to the conventional back assembly, and has an inner rim 2, a backpost (not shown) and a back beam 3, which have been integrally assembled, a soundboard 4 adhered to overlay the top surfaces of these components, and so on, all of which are made of wood materials. The soundboard 4 has been previously formed with a crown in a manner similar to the aforementioned conventional soundboard. Also, individually worked long bridge 5 and short bridge 6, which have predetermined thicknesses and shapes, are adhered on the top surface of the soundboard 4. For the bridges, the bridge shaving and the bridge pin striking had been completed.

For mounting the plate 7 on the back assembly 1 constructed as described above, first, the heights of the long bridge 5 and the short bridge 6 are measured by a bridge height sensor 12 with reference to the bottom surface of the inner rim 2 as a reference plane, as shown in FIG. 3A. The bridge height sensor 12 is attached to a NC machine for forming dowel holes 8*a* and lower holes 8*b,* and can be driven under the control of the NC machine to measure the height at an arbitrary position of the long bridge 5 and the short bridge 6. In the first embodiment, the bridge height measurements are made at seven positions indicated in FIG. 4, i.e., a lower sound side end region, a central region and a higher sound side end region of the short bridge 6 (measuring positions (1)–(3), respectively), and a lower sound side end region, a central region, a region on the higher sound side of the central region, and a higher sound side end region of the long bridge 5 (measuring positions (4)–(7)), for reasons later described.

Next, the depth of each dowel hole 8*a* into which a dowel 9 is driven, is determined in accordance with the measured bridge height associated therewith. As illustrated in FIG. 3B, two dowel holes 8*a* on both sides of a lower hole 8*b* are grouped as a set as before, and a total of ten sets of two dowel holes 8*a* together with one lower hole 8*b* intervening therebetween for screwing, are formed at predetermined positions along the outer periphery of the top surface of the back assembly 1. The depth of each dowel hole 8*a* is determined in the following manner. Specifically, as shown in FIG. 4, the bridge height measuring positions (1)–(7) are corresponded to the sets of dowel holes 8*a* located closest thereto, respectively. For example, the measuring position (1) corresponds to the dowel holes 8*a* at the closest positions C, D. Then, the depths of the dowel holes 8*a* in each set are calculated in accordance with the bridge heights measured at the measuring positions corresponding thereto conforming to a predetermined equation empirically determined therefor in order to provide an appropriate bridge pressure.

Figure 5A:
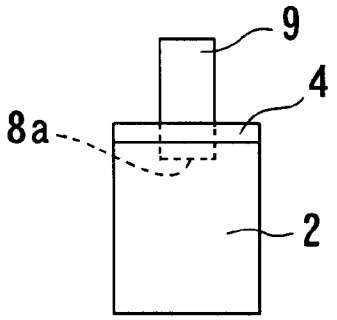
FIG. 5A shows how a dowel hole is formed in accordance with the height of the bridge in the first embodiment.
Figure 5B:
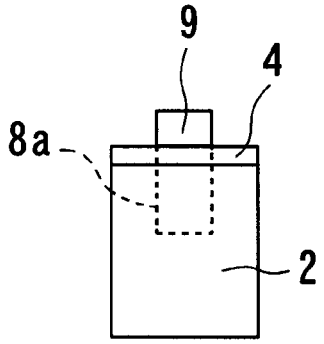
FIG. 5B shows how a dowel is driven into the dowel hole in the first embodiment.

In this way, the depth of the dowel hole 8*a* is set shallower such that the installation height of an associated dowel 9 is higher when the bridge height at the corresponding measuring position is higher, as shown in FIG. 5A. and is set deeper such that the installation height of the dowel 9 is lower when the bridge height is lower, as shown in FIG. 5B. The dowel holes 8*a* in the same set (for example, dowel holes at positions A, B) may have the same depth or different depths. In the example shown in FIG. 4, three sets of dowel holes 8*a* are not corresponded to any of the measuring positions (1)–(7). The depths of these dowel holes 8*a* may be determined in accordance with the result of additionally measuring the bridge height at the positions closest to the respective ones, or determined by interpolation from the result of calculations for the depths of two sets of dowel holes 8*a* on both sides of them.

Next, as illustrated in FIG. 3B, the plurality of dowel holes 8*a* are formed together with the lower holes 8*b* associated therewith at the predetermined positions along the outer periphery of the top surface of the back assembly 1, using a NC machine not shown, to the respective depths determined as described above. Next, a wood-made dowel 9 having a predetermined length is driven into each dowel hole 8*a* to the bottom. In this way, the installation height of each dowel 9 is adjusted higher when the bridge height at the corresponding measuring position is high, and lower when the bridge height is low (see FIG. 5). Next, the plate 7 is carried on the dowels 9, and mounting screws 11 are inserted through bolt holes 10 formed through the plate 7 into the lower holes 8*b,* and fastened to mount the plate 7 on the back assembly 1, in a similar manner described previous with reference to FIG. 1.

As described above, according to the first embodiment, since the depth of each dowel hole 8*a,* i.e., the height of each driven dowel 9 is determined in accordance with the actual height of the long bridge 5 or the short bridge 6 measured at the position closest thereto, a relative height relationship between the long bridge 5 and the short bridge 6 and the plate 7 fixed as carried on the dowels 9, i.e., the bridge pressure can be accurately and optimally controlled in accordance with the actual shape of the crown of the soundboard 4 previously formed thereon and the distribution thereof. As a result, an optimal bridge pressure can be ensured with the plate 7 mounted on the back assembly 1 in the manner described above, thereby eliminating subsequent bridge pressure setting and re-adjustment. Also, since the method of mounting the plate 7 according to the first embodiment employs the dowels 9 similar to the conventional ones as plate bases, and only adds to the conventional mounting method the step of measuring the heights of the long bridge 5 and the short bridge 6, and the step of forming the respective dowel holes 8*a* at predetermined depths determined in accordance with the result of the measurement, the method of the first embodiment can be relatively easily implemented.

Figure 6A:
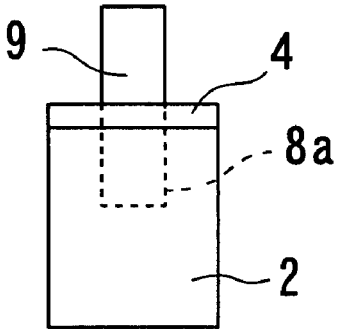
FIGS. 6A and 6B show how a dowel is driven into a dowel hole and is adjusted in accordance with the height of a bridge in a second embodiment.
Figure 6B:
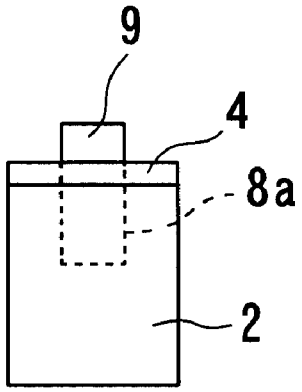

FIGS. 6A and 6B show a second embodiment of the present invention. The second embodiment differs from the first embodiment in that the height of each dowel 9 is controlled to a predetermined height in accordance with the height of an associated bridge by cutting the top surface of the dowel 9 which has been driven into the dowel hole 8*a,* instead of controlling the depth of the dowel hole 8*a* in accordance with the height of the bridge. The rest of the structure is completely similar to the first embodiment. Therefore, similar to the first embodiment, the second embodiment can accurately provide an optimal bridge pressure in accordance with the actual amount of swelling of the soundboard 4 and the distribution thereof, with the plate 7 mounted on the back assembly 1.

Figure 7A:
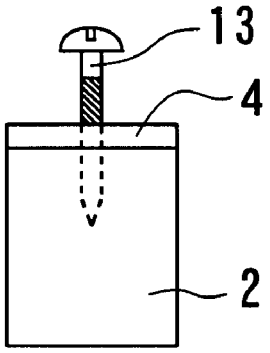
FIGS. 7A and 7B show how an adjusting screw is screwed into an inner rim and adjusted in accordance with the height of a bridge in a third embodiment.
Figure 7B:
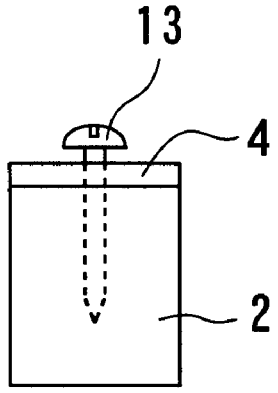

FIG. 7 shows a third embodiment of the present invention. The third embodiment differs from the foregoing two embodiments in that instead of the dowel holes 8*a* and the dowels 9, a plurality of adjusting screws 13 are screwed into the back assembly 1 at the same positions as in the foregoing embodiments as plate bases, such that the heights of the respective adjusting screws 13 are controlled to predetermined heights in accordance with the heights of the bridges by adjusting the amount of screwing strokes of the respective screws 13. The rest of the structure is completely similar to the foregoing two embodiments. Therefore, the third embodiment can also have the aforementioned effects of the two embodiments as well.

It should be understood that the present invention is not limited to the foregoing embodiments, but may be implemented in a variety of manners. For example, while the first and second embodiments employ the pin-shaped dowels 9 as the plate bases for carrying the plate 7 thereon, the configuration of the plate bases is arbitrary. For example, block-like plate bases fitted into receiving holes formed in the back assembly 1 may be employed, in which case the depths of the receiving holes and the height of the plate bases themselves are controlled in accordance with measured heights of the bridges.

Also, while in the foregoing embodiments, the heights of two bridges are measured at a plurality of predetermined positions thereof to attach a plurality of plate bases corresponding to the measured heights of the two bridges, such bridge height measurements may be made only for one of the bridges, in which case the plate bases may be attached corresponding to the measured heights of the one bridge at locations associated therewith.

Otherwise, the present invention may be modified in details of the structure and so on as appropriate within the spirit and scope of the present invention as set forth in the appended claims.

As described above in detail, the method of mounting a plate in a grand piano according to the present invention advantageously ensures an appropriate bridge pressure in accordance with an actual amount of swelling of a soundboard and its distribution in a simple manner without requiring the bridge pressure setting and readjustment.

What is claimed is:

1. A method of mounting a plate on a back assembly having a soundboard assembled therein and a bridge adhered on a top surface of said soundboard in a grand piano, said method comprising the steps of:

measuring heights of said bridge from a reference plane at a plurality of predetermined positions of said bridge on said back assembly;

attaching a plurality of plate bases at a plurality of positions along the outer periphery of the top surface of said back assembly at heights corresponding to the measured heights of said bridge; and carrying said plate on said plurality of plate bases, and fixing said plate carried on said plate bases to said back assembly.

2. A method of mounting a plate in a grand piano according to claim 1, wherein said predetermined heights of said plurality of plate bases are individually determined in accordance with the height of said bridge measured at the position closest to each of said plate bases.

3. A method of mounting a plate in a grand piano according to claim 1 or 2, wherein:

said plurality of plate bases comprise a plurality of buried members mutually having the same predetermined height, said step of attaching said plate bases comprising the steps of:

forming a plurality of burying holes at predetermined depths in accordance with the measured heights of said bridge at said plurality of positions on the top surface of said back assembly; and burying said plurality of buried members into said plurality of burying holes to the bottom thereof.

4. A method of mounting a plate in a grand piano according to claim 1 or 2, wherein:

said plurality of plate bases comprise a plurality of buried members, said step of attaching said plate bases comprising the steps of:

forming a plurality of burying holes at said plurality of positions on the top surface of said back assembly;

burying said plurality of buried members into said plurality of burying holes, respectively; and planing top surfaces of said buried members buried into said burying holes to respective predetermined heights in accordance with the measured heights of said bridge.

5. A method of mounting a plate in a grand piano according to claim 3, wherein:

said plurality of burying holes comprise a plurality of dowel holes; and said plurality of buried members comprise a plurality of dowels respectively driven into said plurality of dowel holes.

6. A method of mounting a plate in a grand piano according to claim 4, wherein:

said plurality of burying holes comprise a plurality of dowel holes; and said plurality of buried members comprise a plurality of dowels respectively driven into said plurality of dowel holes.

7. A method of mounting a plate in a grand piano according to claim 1 or 2, wherein:

said plurality of plate bases comprise a plurality of adjusting screws, said step of attaching said plate bases comprises screwing said plurality of adjusting screws respectively into said plurality of positions on the top surface of said back assembly such that the height of said adjusting screws is equal to a predetermined height in accordance with the measured heights of said bridge.

* * * * *